US007766325B2

(12) United States Patent
Sagi et al.

(10) Patent No.: US 7,766,325 B2
(45) Date of Patent: Aug. 3, 2010

(54) PAPER ROTATION METHOD AND APPARATUS

(75) Inventors: Daniel Sagi, Nes-Ziona (IL); Aron Shmaiser, Rishon-Lezion (IL); Avi Barazani, Rishon-Lezion (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 1292 days.

(21) Appl. No.: 10/870,140

(22) Filed: Jun. 16, 2004

(65) Prior Publication Data

US 2005/0280200 A1 Dec. 22, 2005

(51) Int. Cl.
*B65H 7/02* (2006.01)

(52) U.S. Cl. ..... 271/227; 271/225; 271/226; 271/184; 271/185

(58) Field of Classification Search ..... 271/225, 271/226, 227
See application file for complete search history.

(56) References Cited

U.S. PATENT DOCUMENTS

| | | | | |
|---|---|---|---|---|
| 5,172,907 | A * | 12/1992 | Kalisiak | 271/227 |
| 5,261,655 | A | 11/1993 | Keller et al. | |
| 5,317,377 | A | 5/1994 | Rubscha et al. | |
| 5,374,049 | A | 12/1994 | Bares et al. | |
| 5,382,013 | A | 1/1995 | Walsh | |
| 5,449,164 | A | 9/1995 | Quesnel et al. | |
| 5,725,211 | A * | 3/1998 | Blanchard et al. | 271/265.02 |
| 5,794,176 | A * | 8/1998 | Milillo | 702/150 |
| 6,019,365 | A * | 2/2000 | Matsumura | 271/227 |
| 6,059,284 | A * | 5/2000 | Wolf et al. | 271/227 |
| RE37,007 | E | 1/2001 | Gerlier | |
| 6,241,236 | B1 | 6/2001 | Bokelman | |
| 6,341,777 | B1 | 1/2002 | Carter | |
| 6,419,222 | B1 | 7/2002 | Morrison et al. | |
| 6,421,514 | B2 * | 7/2002 | Yamanaka et al. | 399/169 |
| 6,920,307 | B2 * | 7/2005 | Howe | 399/395 |
| 2002/0048475 | A1 * | 4/2002 | Kojima | 399/405 |
| 2002/0063906 | A1 * | 5/2002 | Isaka et al. | 358/498 |
| 2002/0145249 | A1 * | 10/2002 | Acquaviva et al. | 271/228 |

FOREIGN PATENT DOCUMENTS

| | | |
|---|---|---|
| EP | 0 679 962 | 11/1995 |
| JP | 59-010958 | 1/1984 |
| JP | 60-244740 | 12/1985 |
| JP | 60-258037 | 12/1985 |
| JP | 62-275951 | * 11/1987 |
| JP | 63147745 | 6/1988 |
| JP | 4-133943 | * 5/1992 |
| JP | 4 339679 | 11/1992 |
| JP | 05-246581 | 9/1993 |
| JP | 07-112852 | 5/1995 |
| JP | 10-045280 | 2/1998 |
| JP | 2003-118887 | 4/2003 |

* cited by examiner

*Primary Examiner*—Patrick Mackey
*Assistant Examiner*—Thomas A Morrison

(57) ABSTRACT

Apparatus for rotating a sheet moving in a first direction, the rotator comprising:

at least one first roller that rotates against a sheet first side, the at least one first roller having a first drive;

at least one second roller that rotates against the sheet first side, the at least one second roller having a second drive that is capable of rotating the second roller independently of the first roller, the second roller being spaced a distance from the at least one first roller in a direction perpendicular to the first direction; and a controller that controls the first and second drives to rotate the sheet around an axis substantially perpendicular to the plane of the sheet.

14 Claims, 2 Drawing Sheets

PAPER ROTATION METHOD AND APPARATUS

FIELD OF THE INVENTION

The present invention relates to a rotator on a duplex imager that rotates a sheet following inversion.

BACKGROUND OF THE INVENTION

To produce accurately positioned duplex (two sided) images, whether by a printer or copier, the front side and rear side images are usually referenced from a same edge of a sheet on which they are printed. Since many inverters invert the sheet so the leading edge (from which the front image is referenced), becomes the trailing edge and since most printers reference the current leading edge, the rear side imager lacks a reference to the image on the front side.

Some prior art duplex imaging systems use relatively complex measurement systems to determine the position of the current trailing edge and use that edge as a reference for the printing of the rear image. Other prior art systems use bulky and/or complex mechanisms to rotate an inverted sheet to restore its reference edge to the lead position; one such system comprising an arm that grabs the sheet, rotates the arm 180 degrees about an end of the arm remote from the sheet and releases the sheet.

A skewed image, i.e., an image whose edges are slanted with respect to the edges of the sheet on which they are printed, is another shortcoming of prior art imagers. As a sheet moves along a printer or copier, it may be subject to air turbulence that causes misalignment. To correct the misalignment, in some printers, a side edge of the moving sheet contacts stationary guide rails along its path so the sheet straightens prior to reaching an imaging station. However, in high speed imaging, the contact time may not be sufficient to straighten the sheet and a skewed image may result.

Occasionally, grossly misaligned sheets override the guide rails, especially if they are too close to the guide rail. Rather than straightening, these sheets remain grossly misaligned and often jam in the next station, for example an imaging station or a sheet inverter. A jam in a station results in wasted time while the imager is shut down to clear the jam.

U.S. Pat. No. RE 37,007 describes a system for de-skewing in which rollers are configured to selectively drive a sheet to correct skew. The rollers are all driven by a common drive mechanism and contact with the sheet is controlled by counter rollers.

SUMMARY OF THE INVENTION

An aspect of some embodiments of the present invention relates to a rotator that rotates an inverted sheet utilizing spaced rollers. In an exemplary embodiment, at least two spaced, driven rollers contact a surface of a sheet and rotate in opposite directions, causing the sheet to revolve around an axis perpendicular to the sheet, thereby reversing the leading and trailing edges.

Optionally, the rotator includes at least one counter roller that presses the sheet against at least one driven roller, thereby preventing the sheet from slipping during rotation. Optionally, the at least one counter roller is friction driven by its friction with the moving sheet. Optionally, the at least one counter roller has more than one degree of rotational freedom. In an embodiment of the invention, counter rollers are provided for each of the driven rollers. Optionally, the rollers are independently driven.

An aspect of some embodiments of the present invention provides a skewed sheet correction system comprising two or more sensors spaced away from each other, the sensors being operationally linked to a controller that controls a sheet rotator. In an exemplary embodiment, the two or more sensors sense a degree of skew along the leading edge of a sheet and provide signals to the controller that directs skew-correcting rotation by the rotator. Optionally, the sheet rotator comprises at least two driven rollers spaced from each other.

An aspect of some embodiments of the present invention provides a sheet trailing edge sensor operationally linked to a controller that controls a sheet rotator. In an exemplary embodiment, the trailing edge sensor senses the trailing edge of a sheet, and directs the rotator to rotate the sheet 180 degrees, bringing the trailing edge to the lead.

An aspect of some embodiments of the present invention provides a system for realigning grossly misaligned sheets.

As in the prior art system described above, an exemplary embodiment of an inventive system comprises a guide rail aligned with a station entry and an optional sheet side offset mechanism. The system also includes a trajectory offset mechanism that acts on a sheet to offset the trajectory of a first side edge away from the guide rail with sufficient offset between the first side edge and the rail so that even a grossly skewed sheet does not override the rail. Optionally, prior to entering a station, the sheet side offset mechanism presses against a second side edge causing the first side edge to contact the guide rail, thereby aligning the sheet with the station entry.

Optionally, the trajectory offset mechanism comprises at least two driven rollers, spaced away from each other, that contact the sheet surface. In an exemplary embodiment, the at least two rollers rotate at different speeds to offset an edge of the sheet from the rail. Alternatively, the at least two driven rollers rotate around a point that is offset a distance from the sheet center, thereby offsetting the edge as the sheet is rotated.

There is thus provided, in accordance with an embodiment of the invention, apparatus for rotating a sheet moving in a first direction, the rotator comprising:

at least one first roller that rotates against a sheet first side, the at least one first roller having a first drive;

at least one second roller that rotates against the sheet first side, the at least one second roller having a second drive that is capable of rotating the second roller independently of the first roller, the second roller being spaced a distance from the at least one first roller in a direction perpendicular to the first direction; and a controller that controls the first and second drives to rotate the sheet around an axis substantially perpendicular to the plane of the sheet.

Optionally, the apparatus comprises at least one counter roller adapted to contact a second side of the sheet opposite at least one of the first and second rollers. Optionally, the at least one counter roller is friction driven. Optionally, the at least one counter roller has freedom of motion along at least two axes.

In an embodiment of the invention, the controller selectively operates the rollers in at least two modes, a first mode in which the rollers rotate with opposite senses, thereby rotating the sheet and a second mode in which the rollers operate with a same sense, thereby advancing the sheet. Optionally, the controller is operative, in a skew correction mode, to rotate the rollers at different rates to correct skew in the sheet. Optionally, the apparatus comprises at least one skew sensor connected to the controller, the at least one skew sensor being adapted to sense skew of the sheet.

In an embodiment of the invention, the controller is operative, in a skew correction mode to rotate the rollers at different rates to correct skew in the sheet. Optionally, the apparatus includes at least one skew sensor connected to the controller, the at least one skew sensor being adapted to sense skew of the sheet.

In an embodiment of the invention, the apparatus includes a trailing edge sensor, the sensor sensing a trailing edge of the sheet as it moves in the given direction. Optionally, the controller causes the rollers to rotate the sheet 180 degrees in response to said sensing, such that leading and trailing edges of the sheet are interchanged.

In a embodiment of the invention, the controller controls the rotation speed of the at least one first roller to differ from the rotation speed of the at least one second roller operative to offset the sheet laterally to the first direction.

In an embodiment of the invention, the center of the sheet as it moves in the first direction is laterally offset to the first direction from the midpoint of the rollers, such that the lateral position of the sheet with respect to a general transport direction is changed during said rotation.

In an embodiment of the invention, the controller causes the rollers to rotate the sheet 180 degrees, such that leading and trailing edges of the sheet are interchanged.

There is further provided, in accordance with an embodiment of the invention, alignment apparatus for laterally aligning a sheet moving in a first direction, the system comprising:

an alignment surface, defining a side boundary;

a sheet edge offset mechanism that offsets a sheet so that it is further from the rail; and an alignment mechanism operative to press the side edge of the sheet against the alignment surface so the sheet side edge substantially aligns with the side boundary.

Optionally, the sheet offset mechanism comprises apparatus for rotating a sheet according to an embodiment of the invention.

There is further provided, in accordance with an embodiment of the invention, apparatus for reversing the leading and trailing edges of a sheet moving in a given direction, comprising:

at least one trailing edge sensor that determines the position of a trailing edge of a sheet traveling along a sheet conveyor;

a rotator that rotates a sheet 180 degrees; and a controller that receives signals from the at least one trailing edge sensor and signals the rotator to rotate the sheet responsive to the passage of the sheet trailing edge.

Optionally, the rotator comprises apparatus for rotating a sheet according to the invention.

There is further provided, in accordance with an embodiment of the invention, duplex printing apparatus comprising:

a first printing engine;

a second printing engine;

a sheet transport system that transports a sheet from the first printing engine after printing on a first side thereof to the second printing engine for printing on the second side, the sheet transport system comprising:

a sheet turner which turns over the sheet while exchanging the leading and tailing edges thereof, and one or more of sheet rotating apparatus, alignment apparatus and apparatus for reversing the leading and trailing edges of a sheet according to the invention.

BRIEF DESCRIPTION OF THE DRAWINGS

The following description of non-limiting exemplary embodiments of the present invention should be read in conjunction with the drawings. Corresponding structures in different drawings are indicated with the same reference numeral. The drawings are.

DETAILED DESCRIPTION OF EXEMPLARY EMBODIMENTS

Figure 1A:
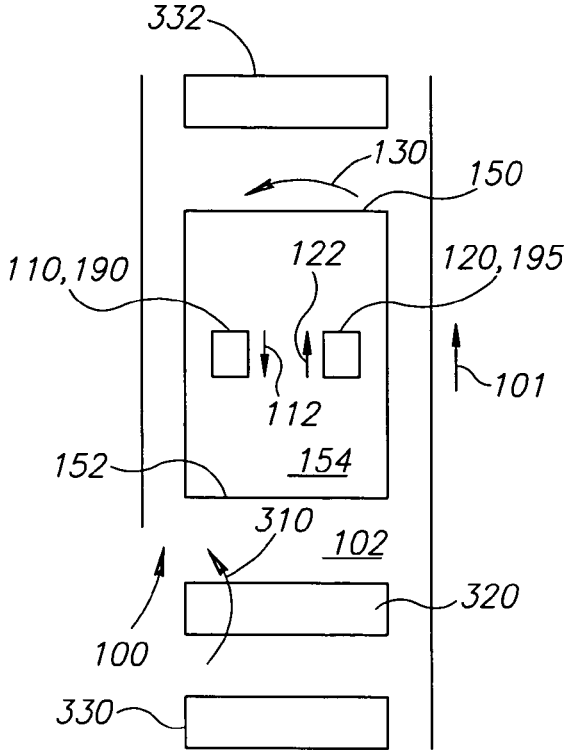
FIG. 1A is a schematic aerial view of a sheet rotator, in accordance with an embodiment of the invention.

FIG. 1A is a schematic aerial view of a sheet rotator 100 located between a turn-over drum 320 and a rear side imager 332 along a sheet conveyor 102, in accordance with an embodiment of the invention. The general direction of a sheet 154 is shown by an arrow 101. After sheet 154 is imaged on a first side by a front side imager shown schematically by box 330, optionally referenced to an edge 152, drum 320 grabs sheet 154 by reference edge 152 and turns the sheet over as indicated by arrow 310. Sheet 154 rolls over drum 320 so that the rear surface becomes uppermost. However, during this flipping action, a trailing edge 150 of the sheet flips forward of reference edge 152. The trailing edge thus becomes the leading edge. As used herein, the terms "turn over" and "flipping" are used interchangeably to denote the act of turning over the sheet so that the positions of the surfaces of the sheet are exchanged. The term "inverted" or "rotated" are used to denote interchanging of the leading and trailing edges. These changes in orientation sometime occur together. Sometimes only one of the changes occurs, such as for example when the leading and trailing edges are interchanged without turning over the sheet.

While a turn-over drum 320 is depicted, the present invention is operable with many alternative prior art flippers, including curved plate inverters or any other sheet flipping mechanism that reverses the leading and trailing edges. The invention is also useful for any other situation in which it is desired to reverse leading and trailing edges, without flipping the sheet.

Following turn-over and inversion by drum 320, sheet 154 moves in direction 101 over driven rollers 110 and 120 of a rotator system 100. Rollers 110 and 120 are optionally overlaid by counter pressure rollers 190 and 195 respectively, to assure that rollers 110 and 120 drive sheet 154. Until sheet 154 is positioned for inversion of the leading and trailing edges or partial rotation, as described below, the sheet is optionally driven by rollers 110 and 120 in direction 101.

When the sheet is positioned for inversion of the leading and tailing edges of sheet 154, rollers 110 and 120 are rotated such that they locally drive the sheet in directions 112 and 122, causing sheet 154 to rotate in a direction 130. With 180 degrees of rotation, reference edge 152 is restored to the lead position.

Optionally, after inverting the leading and trailing edges rollers 110 and 120 both rotate together in a direction to drive sheet 154 in direction 101, until trailing edge 150 is released by rollers 110 and 120. Alternatively or additionally, sheet 154 may be conveyed directly after rotation by other means for example, by conveyor 102. Conveyor 102 may comprise a series of rollers, one or more moving belts or any of the many known conveyor systems.

The variety of desirable motions is facilitated if rollers 110 and 120 are independently rotatable and/or driven.

Figure 1B:
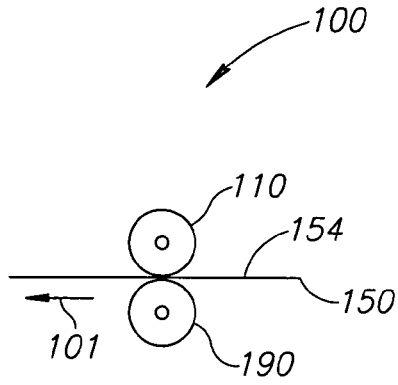
FIG. 1B is a side view of a portion of the sheet rotator of FIG. 1A, in accordance with an embodiment of the invention.

FIG. 1B is a side view of a portion of rotator 100, showing roller 110 positioned against sheet 154 and counter roll 190 pressing sheet 154 against roller 110, thereby preventing slippage of sheet 154 as roller 110 rotates. In an exemplary embodiment, counter roller 190 is driveless, rotating as a result of friction with sheet 154. Optionally, counter roller 190 may have two or more degrees of freedom and, for example, may have a spherical surface, to avoid slippage as sheet 154 is rotated.

During conveying, sheet 154 may be skewed, especially as the sheet moves at high speeds. When skewing occurs prior to entering an imager, for example front side imager 330, the resultant image is skewed with respect to sheet 154.

Figure 2:
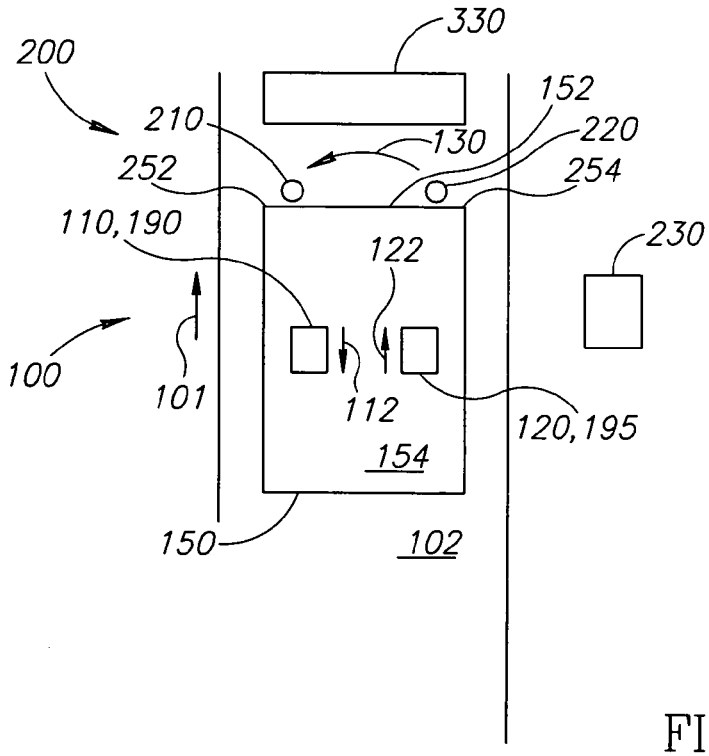
FIG. 2 is a schematic aerial view of a skewed edge sensor system, in accordance with an embodiment of the invention.

FIG. 2 is a schematic aerial view of a skewed edge sensor system 200 comprising sensors 210 and 220 that sense the position of leading edge 152 after inversion of the leading and trailing edges. In an exemplary embodiment, sensors 220 and 210 are connected to a controller 230 that controls the rotation of independently driven rollers 110 and 120. When controller 230 senses a skew along reference edge 152 (for example, determining that the sheet passes the sensors at different times) controller 230 directs rollers 110 and/or 120 to correct the skew. For example, when corner 252 is forward of corner 254, controller 230 directs roller 110 to briefly drive the sheet in direction 112 and/or roller 120 to briefly drive the sheet in direction 122. As above. Sheet 154 rotates in direction 130 until reference edge 152 is no longer skewed.

While skewed edge sensor system 200 and rotator 100 are shown located upstream of rear side imager 330, they could be located anywhere along conveyor 102. For example they may be located prior to rear imager 332 (FIG. 1A) or prior to any station, a station comprising any sheet processor, for example inverter 320 or a sheet stacker mechanism (not shown).

Reversing the leading and trailing edges using rollers 110 and 120 can take with the sheet located at substantially any position along the length of sheet 154. If only a single size sheet is used, then, in an embodiment of the invention, a sensor or sensors, such as sensors 210, 220 of FIG. 2 are used to sense when the leading and trailing edges should be reversed. Until the sheet reaches the sensor(s), rollers 110 and 120 both drive the sheet in direction 101, moving the sheet forward. When the leading edge is sensed by the sensor(s), the direction of rotation of one of the rollers is reversed, reversing the leading and trailing edges, as described above. For sheets of nominal length, after this rotation, the new leading edge will be substantially in the same place as the previous leading edge.

However, when sheet 154 has a different length other than nominal, after rotation, edge 150 is in a different position formerly occupied by reference edge 152. As a result, the front and rear images may be imaged at different distances from reference edge 152, unless an additional step of leading edge alignment is carried out. Usually, the longest length to be printed is the "nominal" and sheets that are not nominal are shorter.

Figure 3:
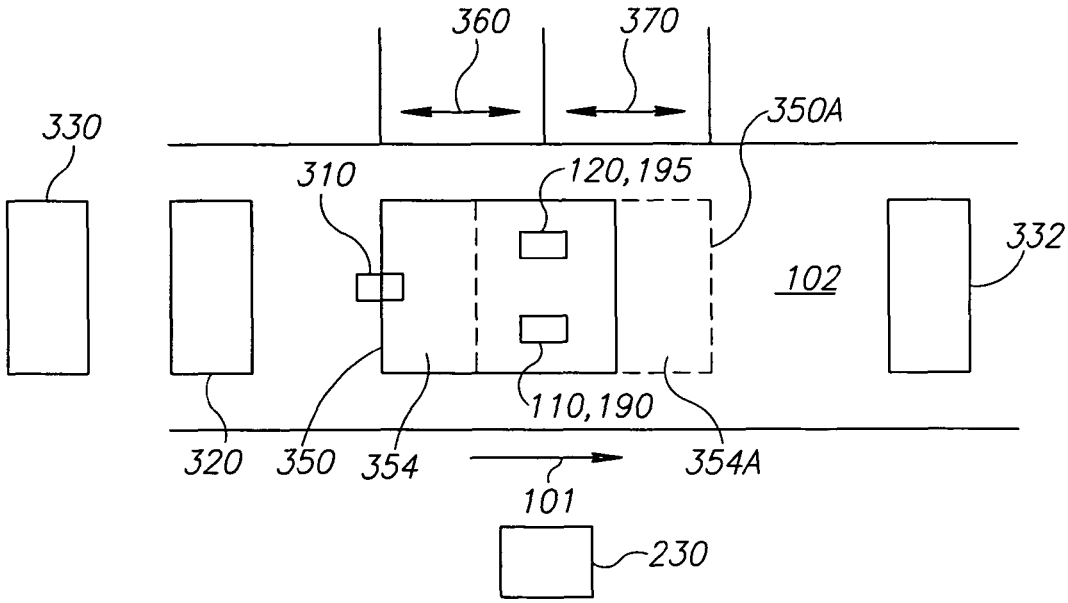
FIG. 3 is a schematic aerial view of a trailing edge sensor system, in accordance with an embodiment of the invention.

FIG. 3 is an aerial view of a system utilizing a trailing edge sensor 310 located along conveyor 102 in a duplex imager, in accordance with an exemplary embodiment of the present invention. In the illustration sheet 354 is a "short" sheet. Following reversal of the leading and trailing edges during a prior flipping of the sheet, a trailing edge 350 passes trailing edge sensor 310. The passage generates a signal that controller 230 utilizes to initiate rotation of short sheet 354 by 180 degrees, using rollers 120 and 110. Solid lines show the position of short sheet 354 and edge 350 prior to rotation while broken lines show the position of short sheet 354A and edge 350A following rotation.

When a trailing edge sensor is used to time the rotation, then after rotation, the position of the leading edge after rotation of the sheet will be the same irrespective of the length of the sheet. This is useful to reduce the amount (and time) of travel and to provide a common timing for the fault determination and subsequent alignment steps (if any), independent of the length of the sheet.

This invariance of the position of the leading edge after rotation can be illustrated by considering the distances 360 and 370. Distance 360 is the distance of the trailing edge from the rollers 110, 120, when rotation is instituted by trailing edge sensor 310. After rotation, the edge 350 has been repositioned to position 350A, a distance 370 from the rollers. Since 360 is substantially the same as distance 370 and since the distance 360 is not dependent on the length of the sheet, position 350A will not depend on the length of the sheet.

Figure 4:
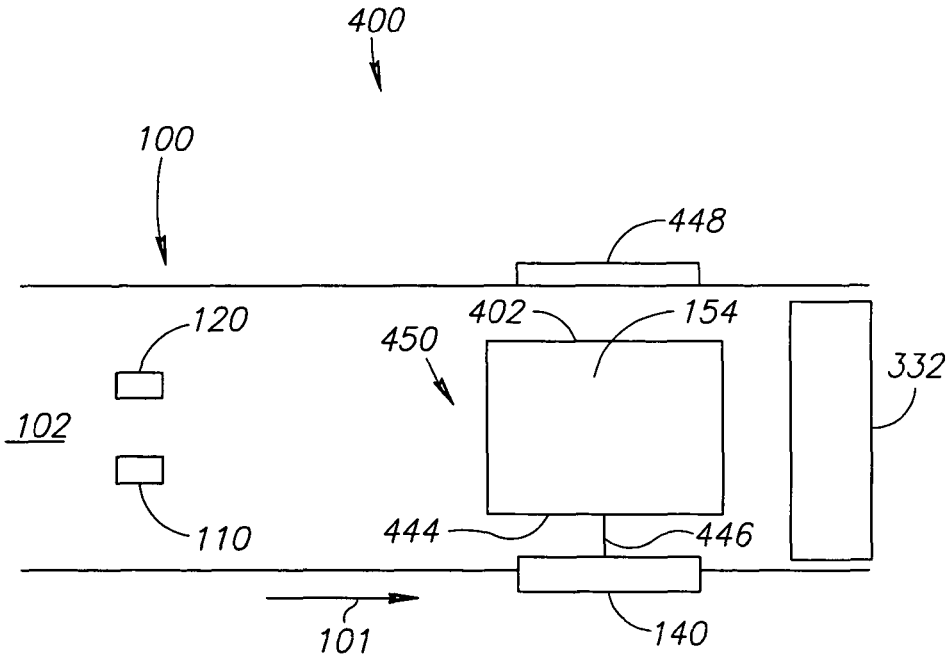
FIG. 4 is an aerial view of a sheet alignment mechanism, according to an embodiment of the invention.

FIG. 4 is an aerial view of a system 400 for aligning sheets 154, even when grossly misaligned. System 100 comprises a trajectory offset mechanism 100 and an alignment mechanism 450.

Alignment mechanism 450 comprises a guide 140 aligned with imager 332, and a sheet transverse offset mechanism 448, which pushes sheet 154 against guide rail, so that the sheet enters imager 332 at a correct transverse (to motion direction 101) position. The inventors have found that to facilitate transverse alignment of the sheet, the sheet should be at least some minimum distance (designated as 446 on FIG. 4) from guide 140. When this distance is too small, there is a tendency for the sheet to override guide 140 or be otherwise unaligned. Such lack of alignment can cause jamming of sheet 154 in imager 332 or improper placement of images on sheet 154.

In an exemplary embodiment, trajectory offset mechanism 100 acts on sheet 154 to offset a first side edge 444 from guide rail 140 by an offset distance 446. In an exemplary embodiment, offset mechanism 100 creates sufficient offset distance 446 between edge 444 and rail 140 so that even a grossly skewed sheet is properly positioned. Prior to entering imager 332, sheet side offset mechanism 448 presses against side 402 of sheet 154, causing side 444 of the sheet to contact guide rail 140, and to be aligned with guide rail 140 and also with imager 332.

The means by which transverse offset mechanism 100 offsets sheet 154 from rail 140 may comprise any of a number of options. For example, the midpoint between rollers 110 and 120 may not align with the midpoint of sheet 154 as it enters these rollers. As rollers 110 and 120 rotate sheet 154 by 180 degrees, sheet 154 is offset laterally to the general direction of motion 101. Alternatively, the rollers can be made to rotate at different rotation rates, such that the sheet rotates about a point that is not at the midpoint between rollers 110 and 120. This will also cause transverse offset of the sheet.

Mechanism 100 can also be used to provide offset, without inverting leading and trailing edges. For example, if one of the rollers is rotated at a speed that is faster than the speed of the other roller, the sheet will be skewed. If the sheet is driven for a period of time in the direction of the skewed leading edge and then deskewed, an offset in the sheet will be generated.

While, alignment system 400 is shown prior to imager 332, transverse sheet offset and alignment can be produced anywhere in the paper path, when needed to provide transverse sheet alignment.

In some embodiments of the invention, other methods of lateral moving of the sheet may be implementing prior to side alignment. Such methods may include physical lateral transport of the sheet and may include methods as are known in the art.

While the present invention has been described with respect to exemplary embodiments thereof, these embodiments are presented by way of example only and are not meant to limit the scope of the invention which is defined by the claims. For example, the functions of offset can be carried out independently, by separate mechanisms or, a combination of two or more of rotation, de-skewing and lateral offset can be performed simultaneously in a single station.

Furthermore, embodiments of the invention may incorporate some but not all features of the above exemplary embodiments and may include combinations of features from different embodiments. As used in the claims the terms "comprise" or "include" and their conjugations shall mean "including but not necessarily limited to."

It will be appreciated by a person skilled in the art that the present invention is not limited by what has thus far been described. Rather, the scope of the present invention is limited only by the following claims.

The invention claimed is:

1. An apparatus for rotating a sheet moving in a first direction, the apparatus comprising:

at least one first roller rotatable against a first side of a sheet, the at least one first roller having a first drive;

at least one second roller rotatable against the first side of the sheet, the at least one second roller having a second drive that is capable of rotating the at least one second roller independently of the at least one first roller, the at least one second roller being spaced a distance from the at least one first roller in a direction perpendicular to the first direction;

at least one counter roller configured to for contact a second side of the sheet opposite the first roller;

a controller configured to control the first and second drives to rotate the sheet around an axis substantially perpendicular to a plane of the sheet; and a trailing edge sensor, the sensor configured to sense a trailing edge of the sheet as it moves in the first direction;

wherein the controller is configured to cause the rollers to rotate the sheet 180 degrees in response to said sensing, such that leading and trailing edges of the sheet are interchanged; and wherein the controller is configured to time rotation of the sheet using input from the trailing edge sensor to position a leading edge of the sheet at a same position irrespective of a length of the sheet, so that the first and second rollers position a leading edge of a longer sheet and a leading edge of a shorter sheet at a same location that is independent of sheet length.

2. Apparatus according to claim 1 in which the at least one counter roller is friction driven.

3. Apparatus according to claim 1 in which the at least one counter roller has freedom of motion along at least two axes.

4. Apparatus according to claim 1 wherein the controller selectively operates the rollers in at least two modes, a first mode in which the rollers rotate with opposite senses, thereby rotating the sheet and a second mode in which the rollers operate with a same sense, thereby advancing the sheet.

5. Apparatus according to claim 4, wherein the controller is operative, in a skew correction mode, to rotate the rollers at different rates to correct skew in the sheet.

6. Apparatus according to claim 5, including at least one skew sensor connected to the controller, the at least one skew sensor being adapted to sense skew of the sheet.

7. Apparatus according to claim 1, wherein the controller is operative, in a skew correction mode to rotate the rollers at different rates to correct skew in the sheet.

8. Apparatus according to claim 7, including at least one skew sensor connected to the controller, the at least one skew sensor being adapted to sense skew of the sheet.

9. Apparatus according to claim 1, wherein the controller controls the rotation speed of the at least one first roller to differ from the rotation speed of the at least one second roller operative to offset the sheet laterally to the first direction.

10. Apparatus according to claim 1 wherein a center of the sheet as it moves in the first direction is laterally offset to the first direction from a midpoint of the rollers, such that the lateral position of the sheet with respect to a general transport direction is changed during said rotation.

11. Duplex printing apparatus comprising:

a first printing engine for printing primarily on a first side of a sheet;

a second printing engine for printing primarily on a second side of the sheet;

a sheet transport system that transports the sheet from the first printing engine after printing on the first side thereof to the second printing engine for printing on the second side, the sheet transport system comprising:

a sheet turner which turns over the sheet while exchanging the leading and trailing edges thereof; and apparatus according to claim 1.

12. A duplex printing apparatus comprising:

a first printing engine;

a second printing engine;

a sheet transport system configured to transport a sheet from the first printing engine after printing on a first side thereof to the second printing engine for printing on the second side, the sheet transport system comprising a sheet turner configured to turn over the sheet while exchanging the leading and trailing edges thereof; and an apparatus for rotating a sheet moving in a first direction, comprising:

at least one first roller rotatable against a sheet first side, the at least one first roller having a first drive;

at least one second roller rotatable against the sheet first side, the at least one second roller having a second drive that is capable of rotating the second roller independently of the first roller, the second roller being spaced a distance from the at least one first roller in a direction perpendicular to the first direction; and a controller configured to control the first and second drives to rotate the sheet around an axis substantially perpendicular to a plane of the sheet and causes the rollers to rotate the sheet 180 degrees, such that leading and trailing edges of the sheet are interchanged;

wherein the controller operates the first and second rollers at different rotation rates, such that the sheet rotates for 180 degrees about a point that is not the midpoint of the sheet to cause a transverse offset of the sheet; and wherein the controller is configured to time rotation of the sheet using input from the trailing edge sensor to position a leading edge of the sheet at a same position irrespective of a length of the sheet, so that the first and second rollers position a leading edge of a longer sheet and a leading edge of a shorter sheet at a same location that is independent of sheet length.

13. An apparatus for rotating a sheet moving in a first direction, the rotator comprising:

at least one first roller that rotates against a sheet first side, the at least one first roller having a first drive;

at least one second roller that rotates against the sheet first side, the at least one second roller having a second drive that is capable of rotating the second roller independently of the first roller, the second roller being spaced a distance from the at least one first roller in a direction perpendicular to the first direction;

a controller that controls the first and second drives to rotate the sheet around an axis substantially perpendicular to a plane of the sheet, wherein the controller causes the rollers to rotate the sheet 180 degrees such that leading and trailing edges of the sheet are interchanged; and a counter roller adapted to contact a second side of the sheet opposite the first roller;

wherein the controller operates the first and second rollers at different rotation rates, such that the sheet rotates for 180 degrees about a point that is not the midpoint of the sheet to cause a transverse offset of the sheet; and wherein the controller is configured to time rotation of the sheet using input from the trailing edge sensor to position a leading edge of the sheet at a same position irrespective of a length of the sheet, so that the first and second rollers position a leading edge of a longer sheet and a leading edge of a shorter sheet at a same location that is independent of sheet length.

14. Apparatus of claim 1, wherein the controller controls the first and second drives at different rotation rates such that the sheet rotates about a point that is not at the midpoint between the at least one first roller and the at least one second roller to laterally traverse the sheet as the sheet is rotated 180 degrees.

* * * * *